United States Patent [19]

Kirby

[11] Patent Number: 4,541,418

[45] Date of Patent: Sep. 17, 1985

[54] SIMULATED HYDROTHERAPY BATH

[75] Inventor: John R. Kirby, Short Hills, N.J.

[73] Assignee: J. A. Preston Corporation, Clifton, N.J.

[21] Appl. No.: 411,405

[22] Filed: Aug. 25, 1982

[51] Int. Cl.[4] ..... A61H 29/00

[52] U.S. Cl. ..... 128/24.1; 52/309.4

[58] Field of Search ..... 128/66, 38, 65, 24.1, 128/359; 52/71, 309.4, 309.9; D21/252; D25/32

[56] References Cited

U.S. PATENT DOCUMENTS

| | | | |
|---|---|---|---|
| D. 229,799 | 1/1974 | Suzuki et al. | D6/13 |
| 2,650,375 | 9/1953 | Serrell | D6/13 |
| 2,975,786 | 3/1961 | Williams | 128/65 |
| 3,258,890 | 7/1966 | Dirkse | 52/309.4 X |
| 3,428,973 | 2/1969 | Hargest et al. | 128/33 X |
| 3,643,941 | 2/1972 | Kashar | 128/24.1 |
| 3,760,800 | 9/1973 | Staffin et al. | 128/24.1 |
| 3,816,234 | 6/1974 | Winfield | 52/309.9 X |
| 3,866,606 | 2/1975 | Hargest | 128/71 |
| 4,214,576 | 7/1980 | Henley | 128/24.1 |
| 4,249,333 | 2/1981 | Chase | 128/359 X |

*Primary Examiner*—Edward M. Coven

*Attorney, Agent, or Firm*—Blum, Kaplan, Friedman Silberman & Beran

[57] ABSTRACT

A simulated hydrotherapy bath that avoids the dangers of water and yet simulates the sensory properties thereof is provided. The pool is comprised of a plurality of upholstered panels, each of which are secured together to define a soft-sided free-standing enclosure. Disposed within the enclosure defined by the panels are a plurality of crushable shape-retentive balls that have a predetermined diameter that is sufficiently large to prevent swallowing of the balls and yet sufficiently small so as to optimize a child's grasp thereof.

18 Claims, 4 Drawing Figures

FIG. 3
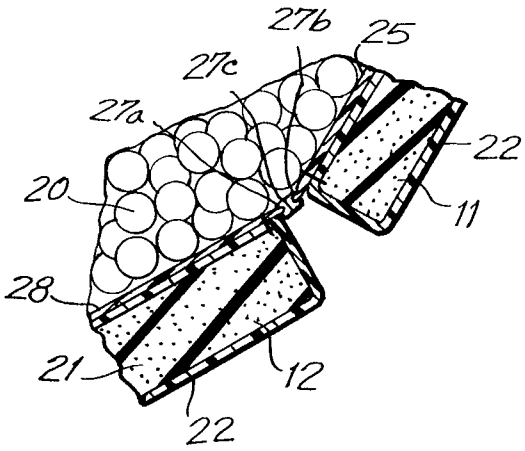
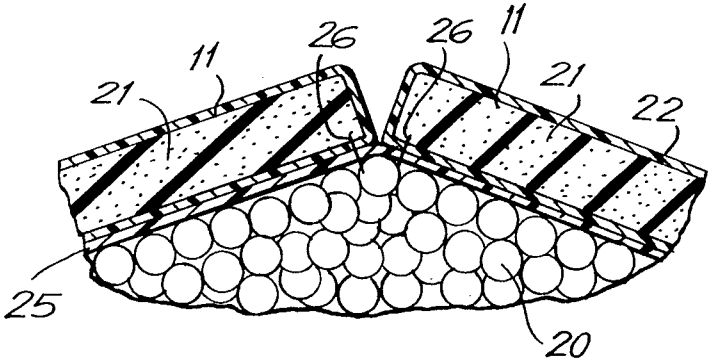
FIG. 4
FIG. 2
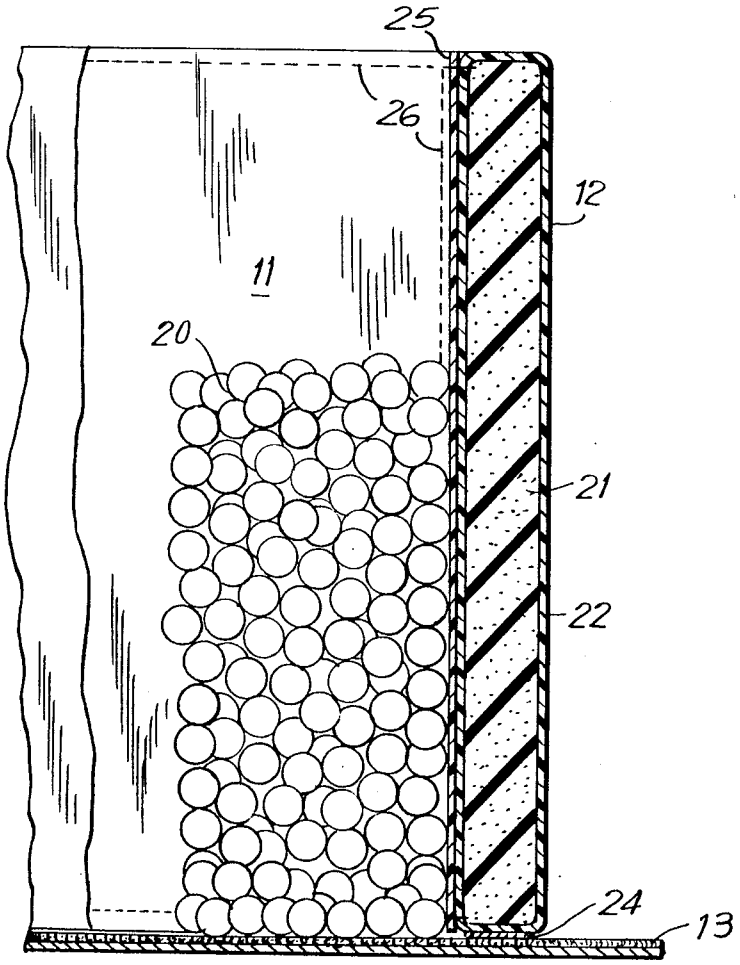

SIMULATED HYDROTHERAPY BATH

BACKGROUND OF THE INVENTION

The present invention is directed to a non-liquid bath for children that simulates a hydrotherapy pool and in particular to a plurality of upholstered panels that define a free-standing enclosure containing a plurality of flexible, crushable and shape-retentive balls that are of a pre-determined size or sizes. The pre-determined size of the balls is such that they are sufficiently large to prevent a child from swallowing the balls and yet are of a small enough diameter to optimize a child's ability to grasp the balls.

Heretofore, swimming/hydrotherapy pools have been used in the treatment of severely disabled children for the purpose of relaxing the child while at the same time stimulating the disabled child's movement and balance. Such disabilities as cerebral palsy, congenital abnormalities, multi-handicaps, traumatic injuries, muscular dystrophy, mental retardation and other various neuromuscular and musculoskeletal disorders are often treated in hydrotherapy pools because of the sensory benefits that immersion in water provides. For example, in addition to visual and tactile feedback, the buoyancy of the water provides a support and reduces the pressure on the body while stimulating the mobility of a child suffering from the above-mentioned disorders. Nevertheless, while the therapeutic benefits provided by a hydrotherapy pool are well known, the danger to the child of drowning without supervisory intervention is apparent. A further problem associated with swimming, or hydrotherapy pools, are their size, weight and the difficulty of insuring a leakproof enclosure in a small area. Accordingly, a simulated hydrotherapy bath that eliminates the use of water is particularly suitable for small indoor enclosures and that provides the benefits heretofor obtainable in a swimming and/or hydrotherapy pool is desired.

SUMMARY OF THE INVENTION

Generally speaking, a simulated hydrotherapy bath is constructed in accordance with the instant invention. The bath is comprised of a plurality of upholstered panels. The upholstered panels are adapted to be secured together to define a soft-sided free-standing enclosure. The enclosure defined by the panels is filled with a plurality of flexible, crushable and shape-retentive balls. Each of the balls is a pre-determined diameter that is sufficiently large to prevent a child from swallowing the ball and is also sufficiently small in diameter so as to permit a child to grasp the ball.

In a preferred embodiment, the upholstered panels are covered with a vinyl material and each of the balls disposed therein are two inch diameter balls in assorted bright colors. The size of each ball permits the child to be supported and encourages movement. The colors of the balls are particularly effective in permitting cognitive development.

Accordingly, it is an object of the instant invention to provide a simulated hydrotherapy bath that has no liquid.

A further object of the instant invention is to provide a simulated hydrotherapy bath for severely disabled children that can minimize intervention with a therapist.

Still another object of the instant invention is to provide a simulated bath having a plurality of balls that provide a disabled child with visual and tactile feedback and sufficient support.

Still a further object of the instant invention is to provide a simulated bath for both handicapped and non-handicapped children that has substantial play value.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawing(s), in which:

FIG. 2 is a sectional view taken along line 2—2 of FIG. 1;

FIG. 3 is a sectional view taken along line 3—3 of FIG. 1; and

FIG. 4 is a sectional view taken along line 4—4 of FIG. 1.

BRIEF DESCRIPTION OF THE PREFERRED EMBODIMENT

Figure 1:
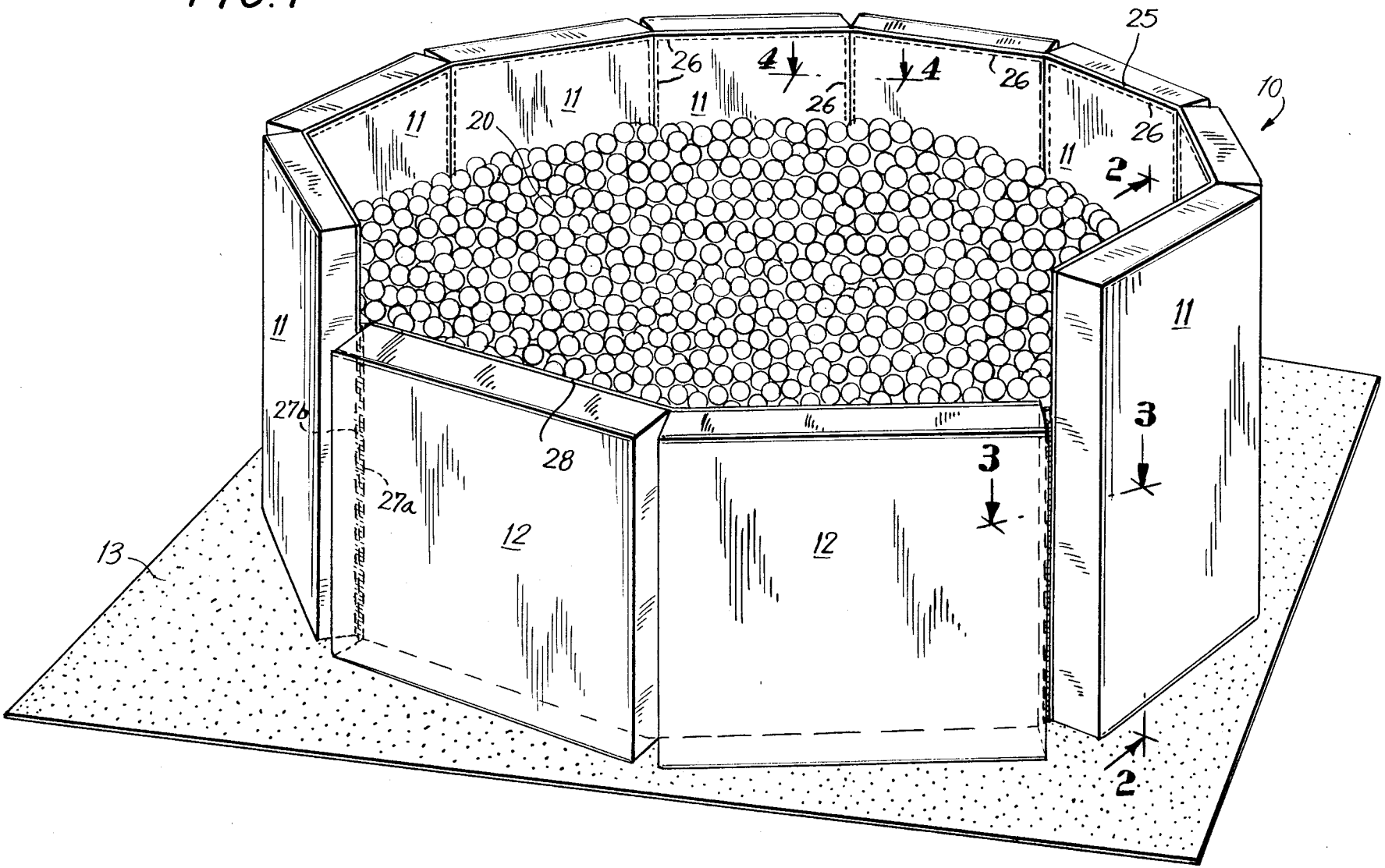
FIG. 1 is a perspective view of a simulated hydrotherapy bath constructed in accordance with a preferred embodiment of the instant invention.

Reference is made of FIG. 1 wherein a simulated hydrotherapy bath, generally indicated as 10, is depicted. In the exemplary embodiment illustrated in FIG. 1, the bath 10 is comprised of eight tall panels 11 and two shorter panels 12 which are secured together to define a corral type enclosure. The enclosure rests upon a carpeted layer 13 and is secured in a manner that is described in greater detail below.

Within the enclosure are a plurality of multi-colored, flexible, plastic balls 20. Each of the balls 20 are flexible, will crush under pressure and will return to their original shape when the pressure is relieved. In a preferred embodiment, the balls are two inches in diameter or 5 centimeters to insure that the balls are too large for a child to swallow. Moreover, balls having a diameter on the order of 2 inches or 5 centimeters have a sufficiently small size to provide an optimum sensory feeling to a child laying upon the balls and further permits a child to easily grasp the balls. Finally, the balls are multi-colored, preferably in colors of red, green, white, black, purple, yellow, orange and blue to provide a bright environment for optimum sensory simulation.

As is illustrated in FIGS. 2, 3 and 4, each of the panels 11 and 12 are formed of a foam substrate 21 covered by an outer vinyl layer 22. The outer vinyl layer 22 is sewn about the foam substrate 21 in a conventional manner. The foam substrate offers a soft, safe environment and yet sufficient structural integrity to permit the respective panels to be secured in an upright free-standing position to define a sufficient structural enclosure. Vinyl layer 22 is preferably impervious to urine and easily washable in order to permit easy maintenance of the bath. On the bottom surface of each panel 11 and 12 are VELCRO ® fastener 24 or other types of known hook fasteners that will anchor each of the panels to a carpeted layer 13 to prevent the panels 11 and 12 from moving out of position with respect to the carpeted layer when one or more bodies are positioned in the bath and are moving freely about therein.

In the exemplary embodiment illustrated in FIG. 1 the eight panels 11 are permanently secured to a washable, water impervious, continuous vinyl sheet 25 by stitching 26. The vertical stitching 26 at the position where each of the panels 11 meet permit the panels 11 to be folded inwardly into any shape but prevents the panels 11 from being folded outwardly with respect to each other. In an exemplary embodiment each of the panels 11 are 28 inches in height, 19.5 inches in length and 3 inches in width. It is apparent that the number of tall panels 11 and short panels 12 is not limited to ten and that any number that if sufficient to define a polygonal shaped enclosure is sufficient. Also it is not necessary that all of the panels 11 are permanently secured together by the continuous sheet 25 and instead each of the panels 11 can be separately secured to each other. However, the continuous sheet does provide for ease of assembly and further structural integrity to the free-standing enclosure defined by the panels.

The remaining two panels 12 each measure 23 inches in height and like the panels 11 are 19.5 inches long and 3 inches wide. The reduced height of the panels 12 facilitates entry and exit from the bath. The panels 12 are secured (not shown) together by a common sheet 28 sewn at their common connection in the same manner as the larger panels 12. The end edge of the shorter panels 12 each include a zipper track 27*a*. A zipper track 27*b* is also provided at the end edges of the two panels 11 that are secured to continuous sheet 25 to permit the second panels 12 to be connected to the remaining shorter panels 11 by a zipper 27*c* for ease of assembly.

Using the number of panels and dimensions aforenoted, the carpet layer 13 should be on the order of a six-foot square so that each of the panels 11 and 12 can be anchored to the rug by the VELCRO fasteners 24 to form an entire tub-like enclosure. Moreover, in addition to anchoring the free-standing panels the layer 13 offers a soft and safe surface for the bottom of the bath. It is noted that the panels can be assembled and a carpeted floor in order to eliminate the necessity of the carpet layer 13.

As aforenoted, in a preferred embodiment each of the balls is of the same diameter and in a free-standing enclosure formed in the manner aforenoted. Approximately eight thousand multi-colored hollow plastic balls will sufficiently fill the vinyl upholstered foam paneled enclosure. With the balls added to the enclosure, a simulated hydrotherapy bath and the benefits which inure thereto are simulated without the wetness or danger associated with a water bath.

The bubble ball bath enables freedom of movement with supportive action for an individual to cushion their body comfortably within the bath. Moreover, the colorful atmosphere permitted by the multi-colored balls offers an individual child visual and tactile stimulation which develops sensory awareness. For a handicapped child, the simulated bath of the instant invention provides therapeutic benefits. For both handicapped and non-handicapped children the bath of the instant invention offers substantial play value. The size, flexibility, crushability and shape retentive qualities of each of the balls presents a relaxing, soft touch and coupled with the upholstered foam panels offers a soft, safe environment for the child. Moreover, the bath of the instant invention permits placement of the severely handicapped child within the bath in order to obtain the therapeutic benefits thereof and yet does not require supervisory intervention which is absolutely essential in a swimming or hydrotherapy pool.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawing(s) shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A simulated bath comprising in combination a plurality of panels, each of said panels being formed of a foam substrate and an outer upholstered outer layer, each of said panels including fastening means for permitting said panels to be releasably secured together to define a free-standing soft-sided enclosure whereby a selected number of panels may be releasably secured together to vary the size of the free-standing enclosure and a plurality of flexible, crushable shape retentive balls disposed in said enclosure, said balls being sufficiently large to prevent said balls from being ingested by a child.

2. A simulated bath as claimed in claim 1, and including a floor means, said floor means being sufficiently sized to permit said free-standing enclosure to be entirely disposed thereon.

3. A simulated bath as claimed in claims 1, or 2, wherein each of said panels includes fastening means, said fastening means being adapted to position said panels on said floor means and prevent said panels from moving with respect to said layer.

4. A simulated bath as claimed in claim 3, wherein at least two of said panels are sewn together to structurally reinforce the free-standing enclosure defined thereby.

5. A simulated bath as claimed in claim 4, wherein at least one of said panels includes fastening means for permitting the remaining panels to be selectively secured thereto to define said free-standing enclosure.

6. A simulated bath as claimed in claim 5, wherein said sewn together panels are sewn together and said remaining panels have fastening means for permitting same to be selectively fastened to said sewn together panels to define said free-standing enclosure.

7. A simulated bath as claimed in claim 5, wherein at least one of said panels is shorter than said other panels to facilitate entry and exit into said simulated bath.

8. A simulated bath as claimed in claim 1, wherein each of said balls are at least 2 inches in diameter.

9. A simulated bath as claimed in claim 1, wherein each of said balls are at least 5 centimeters in diameter.

10. A simulated bath as claimed in claims 8 or 9, wherein each of said balls are multi-colored for providing sensory stimulation.

11. A simulated bath as claimed in claims 8 or 9, wherein each of said balls has substantially the same diameter.

12. A simulated bath as claimed in claims 1, 2, or 9, wherein said number of panels is at least four.

13. A simulated bath as claimed in claim 12, wherein at least one of said panels is shorter than said remaining panels to facilitate entry and exit into said simulated bath.

14. A simulated hydrotherapy bath comprising in combination a plurality of crushable and resilient panels, each of said panels including fastening means for permitting said panels to be secured together to define a free-standing enclosure whereby a selected number of said panels may be releasbly secured together to vary the size of the free-standing enclosure and a plurality of flexible, crushable and shape retentive balls disposed in said enclosure, each of said balls being at least five centimeters in diameter so that the balls are sufficiently large to prevent said balls from being ingested by a child.

15. A simulated hydrotherapy bath, as claimed in claim 14, wherein each of said balls are multicolored for providing sensory stimulation.

16. A simulated hydrotherapy bath, as claimed in claim 15, wherein each of said balls have substantially the same diameter.

17. A simulated hydrotherapy bath, as claimed in claim 16, wherein the number of panels is at least four.

18. A simulated hydrotherapy bath, as claimed in claim 17, wherein at least one of said panels is shorter than said remaining panels to facilitate entry and exit into said simulated hydrotherapy.

* * * * *